US009638451B2

(12) United States Patent
Cravens

(10) Patent No.: US 9,638,451 B2
(45) Date of Patent: May 2, 2017

(54) CLAD METAL ICE CUBE TRAY

(71) Applicant: Whirlpool Corporation, Benton Harbor, MI (US)

(72) Inventor: Charles R. Cravens, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 249 days.

(21) Appl. No.: 14/187,520

(22) Filed: Feb. 24, 2014

(65) Prior Publication Data

US 2015/0241103 A1 Aug. 27, 2015

(51) Int. Cl.

| | |
|---|---|
| ***F25C 1/22*** | (2006.01) |
| ***F25C 5/02*** | (2006.01) |
| ***F25C 5/08*** | (2006.01) |
| ***F25C 5/06*** | (2006.01) |
| ***F25C 1/24*** | (2006.01) |
| *C22C 38/40* | (2006.01) |
| *C22C 38/08* | (2006.01) |

(52) U.S. Cl.

CPC ..... *F25C 5/08* (2013.01); *F25C 1/24* (2013.01); *F25C 5/06* (2013.01); *C22C 38/08* (2013.01); *C22C 38/40* (2013.01); *F25C 2400/02* (2013.01)

(58) Field of Classification Search

CPC ..... F25C 1/22; F25C 1/24; F25C 5/02; F25C 5/06; F25C 5/08; C22C 38/08; C22C 38/40

See application file for complete search history.

(56) References Cited

U.S. PATENT DOCUMENTS

| | | | | | |
|---|---|---|---|---|---|
| 1,726,489 | A * | 8/1929 | Hybinette | C22C 38/08 | 420/108 |
| 1,852,064 | A * | 4/1932 | Rosenberg | F25C 1/24 | 62/344 |
| 1,933,615 | A * | 11/1933 | Babcock | F25C 1/24 | 62/135 |
| 2,296,327 | A * | 9/1942 | Barish | F25C 1/24 | 220/671 |
| 2,404,973 | A * | 7/1946 | Mallard | F25C 1/24 | 249/70 |
| 3,640,704 | A * | 2/1972 | Robertshaw | C22C 38/08 | 148/328 |
| 5,408,844 | A * | 4/1995 | Stokes | F25C 5/08 | 249/79 |
| 5,705,548 | A * | 1/1998 | Matsuoka | C08K 5/315 | 524/209 |
| 2012/0297815 | A1* | 11/2012 | DeVos | F25C 5/08 | 62/351 |

* cited by examiner

*Primary Examiner* — Christopher R Zerphey
(74) *Attorney, Agent, or Firm* — Nyemaster Goode, P.C.

(57) ABSTRACT

A clad metal ice forming tray assembly for a refrigerator is disclosed. The ice forming tray includes a clad metal comprised of at least a first alloy sheet and a second alloy sheet different from the first and having different coefficients of thermal expansion. The tray also includes ice recesses stamped in the clad bi-metal.

13 Claims, 4 Drawing Sheets

CLAD METAL ICE CUBE TRAY

BACKGROUND OF THE INVENTION

Various types of trays have been developed for forming ice cubes. Many modern refrigerator appliances possess automatic ice-making capabilities. Although these ice makers are highly desirable, they have some distinct disadvantages. Automatic dispensing ice cube trays require heat and/or mechanical action to release the ice. Additionally, conventional die cast trays with heaters and harvesters use a large amount of energy, and plastic twist trays can be slow and unreliable.

BRIEF DESCRIPTION OF THE INVENTION

One aspect of the present invention includes a clad metal ice forming tray assembly for a refrigerator. The ice forming tray comprises a clad metal having at least a first alloy sheet and a second alloy sheet different from the first and having different coefficients of thermal expansion; and an ice recess stamped in the clad bi-metal, defined along its bottom by a bottom surface and its sides by at least one wall extending upwardly from the bottom surface, wherein the bottom surface and the at least one wall comprise the clad bi-metal. Each of the bottom surface and the at least one walls comprises an interior surface which is facing the ice recess and an exterior surface which is facing away from the ice recess.

Another aspect of the present invention is a method of releasing ice from a clad metal ice forming tray assembly for a refrigerator. The method includes the steps of providing a clad metal ice forming tray comprising a clad metal having at least a first alloy sheet and a second alloy sheet different from the first and having different coefficients of thermal expansion and at least one ice recess stamped in the clad bi-metal, defined along its bottom by a bottom surface and its sides by at least one wall extending upwardly from the bottom surface, wherein the bottom surface and the at least one wall comprise the clad bi-metal, wherein each of the bottom surface and the at least one walls comprises an interior surface which is facing the ice recess and an exterior surface which is facing away from the ice recess; providing ice in the at least one ice recess; creating shear stress between the ice forming tray and the ice by modifying the temperature of the ice forming tray or applying electrical resistive heating such that one of the first or second alloy sheets expands due to its coefficient of thermal expansion. The expansion causes the ice forming tray to release the ice.

Another aspect of the present invention is an ice maker. The ice maker includes a housing defining an interior volume; a clad metal ice forming tray coupled with the housing and horizontally suspended within the interior volume of the housing, and comprising a clad metal comprised of at least a first alloy sheet and a second alloy sheet different from the first and having different coefficients of thermal expansion and at least one ice recess stamped in the clad bi-metal, defined along its bottom by a bottom surface and its sides by at least one wall extending upwardly from the bottom surface, wherein the bottom surface and the at least one wall comprise the clad bi-metal, wherein each of the bottom surface and the at least one walls comprises an interior surface which is facing the ice recess and an exterior surface which is facing away from the ice recess; and a cooling source thermally coupled to the ice forming tray and configured to freeze water retained within the ice recesses.

DESCRIPTION OF EMBODIMENTS OF THE INVENTION

Figure 1:
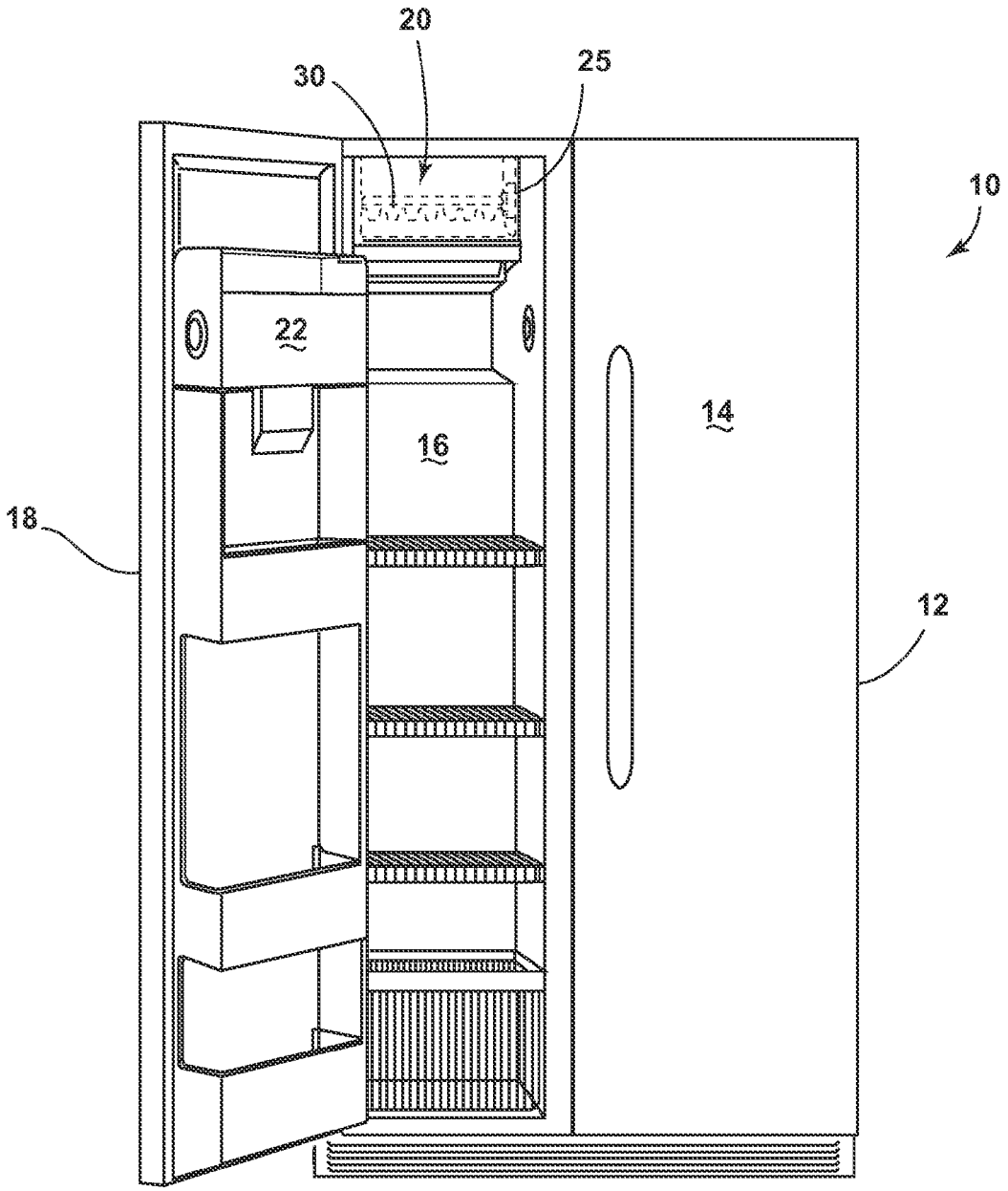
FIG. 1 is a perspective view of a refrigerator appliance with the freezer door in an open position and illustrating an automatic ice maker with an ice tray according to a first embodiment of the invention.

In FIG. 1, a refrigerator 10 includes a fresh food compartment 12, a fresh food compartment door 14, a freezer compartment 16, and freezer compartment door 18. Freezer compartment door 18 is shown in an open position in FIG. 1, revealing an automatic ice maker 20 and ice piece collection receptacle 22. Also, FIG. 1 shows the refrigerator as a side-by-side configuration, but it should be understood that a refrigerator may be any configuration, such as a French door bottom-mount freezer or top mount freezer configuration. The ice maker 20 includes a housing 25. Located within the housing 25 is an ice-making assembly 30. It should be understood that the ice maker 20 and ice-making assembly 30 can be configured in various locations within refrigerator 10, including within the freezer compartment 16, fresh food compartment 12, fresh food compartment door 14, and freezer door 18. Also, the automatic ice maker 20 and ice making assembly 30 may be used within any freezer environment, including freezer, ice-making, and ice-storage appliances.

Figure 2:
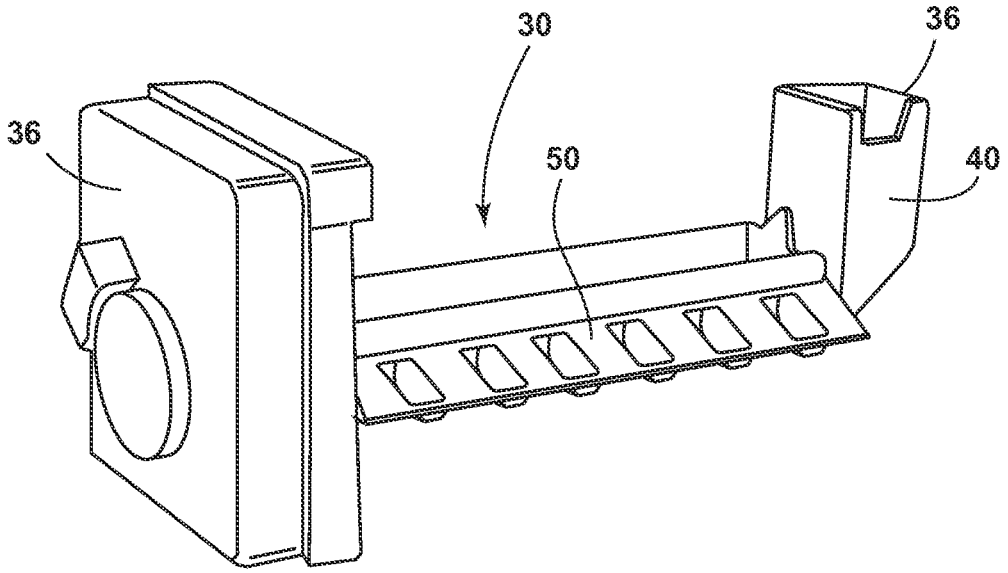
FIG. 2 is a perspective view of an ice maker that includes an ice-making assembly configured to release ice pieces during ice making operations.

FIG. 2 depicts an ice-making assembly 30. The assembly 30 may be coupled with the housing 25 and suspended within an interior volume of the housing 25. The assembly 30 includes a frame body 40 that may be secured to the housing 25 or some other stable, supporting surface within the refrigerator 10. The frame body 40 may be constructed of any number of durable, rigid (e.g., possess a relatively high elastic modulus), food-safe materials including certain polymeric and metal materials. It should also be understood that the frame body 40 can be fabricated in various configurations, sizes, and orientations, provided that the frame body 40 can be fastened to surface(s) within the refrigerator 10 and provide support for other components of the ice-making assembly 30. The frame body 40 typically has end walls 36 and side elevating walls (not shown) on each side that form support legs and elevate the ice-forming tray 50. It should be understood that the ice-forming tray 50 may be any type of mold for forming ice.

Figure 3:
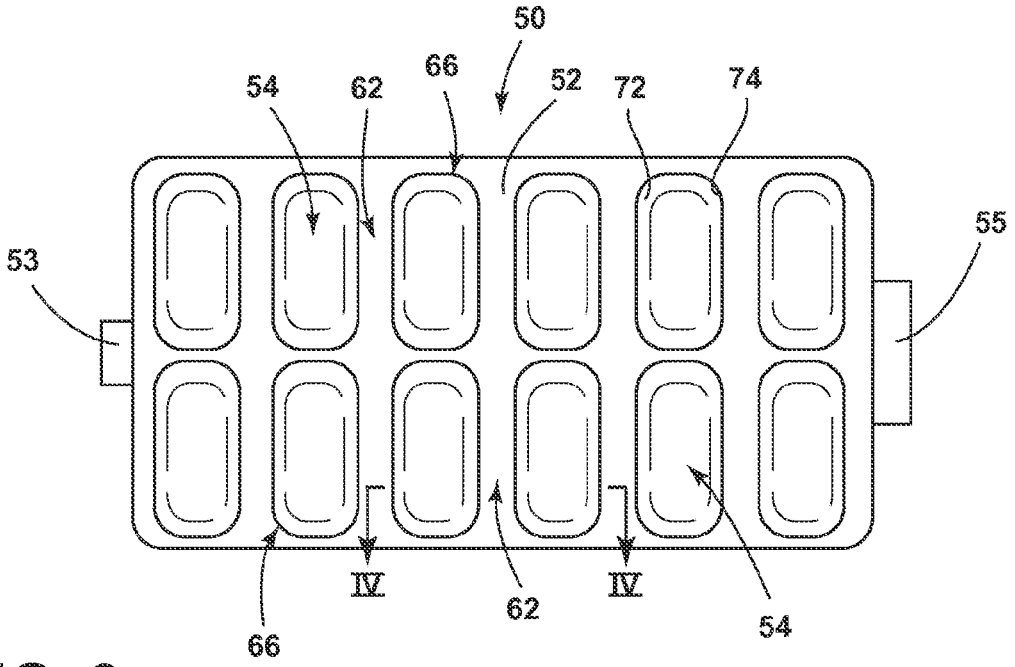
FIG. 3 is a plan view of an ice tray according to one aspect of the present disclosure.

As shown in FIGS. 2 and 3, the ice-forming tray 50 is located within the frame body 40. The ice-forming tray 50 includes a body portion 52, a plurality of ice-forming recesses 54, a first tray connector 53, and a second tray connector 55. The body portion 52 and recesses 54 are preferably formed from a single piece of clad metal that has two different alloy sheets of similar thickness joined together. For example, the ice tray 50 may be formed from a clad metal having a thickness of about 0.25 millimeters to about 1.7 millimeters. Preferably, the clad metal has an overall thickness of about 0.5 millimeters. The ice tray 50 may be formed from a flat sheet of metal using a known stamping process or other suitable techniques such as high velocity metal forming.

The first tray connector 53 includes a tray connector pin (not shown) that is coupled to the frame body 40. The tray connector pin rests within a frame body hub (not shown), allowing the ice-forming tray 50 to rotate along the axis of the pin. The second connector 55 includes a tray connector pin (not shown) that is coupled to a driving body (not shown) adapted to impart clock-wise and counter-clockwise rotational motion to the ice-forming tray 50 by known means.

Although not depicted, an apparatus for filling the ice-forming recesses 54 of tray 50 with water (or other desired liquids) may comprise any of the various, known configurations for performing this function. Various tubing, pumps, metering devices, and sensors can be used in conjunction with a controller to dispense water in the tray 50 during ice-making operations. The controller (not shown) can be configured to control the water dispensing aspect of the ice-making assembly 30, along with the ice harvesting and freezing aspects of the operation. A fluid line (not shown) may extend into an interior volume of the housing and having an outlet positioned above the clad metal ice forming tray 50 and configured to dispense water over the clad metal ice forming tray 50 to be retained within the ice recesses 54.

Although also not depicted, a cooling source may be thermally coupled to the ice forming tray 50 and configured to freeze water retained within ice recesses 54. The cooling source may be a thermoelectric device or an evaporator element having a first side engaged with the bottom surface of the clad metal ice forming tray 50. A heating source, such as a resistance wire heater or a thick film heater, may also be thermally coupled to the ice forming tray 50 and configured to heat the ice forming tray 50 to aid in releasing ice pieces from the ice forming tray 50.

Figure 4:
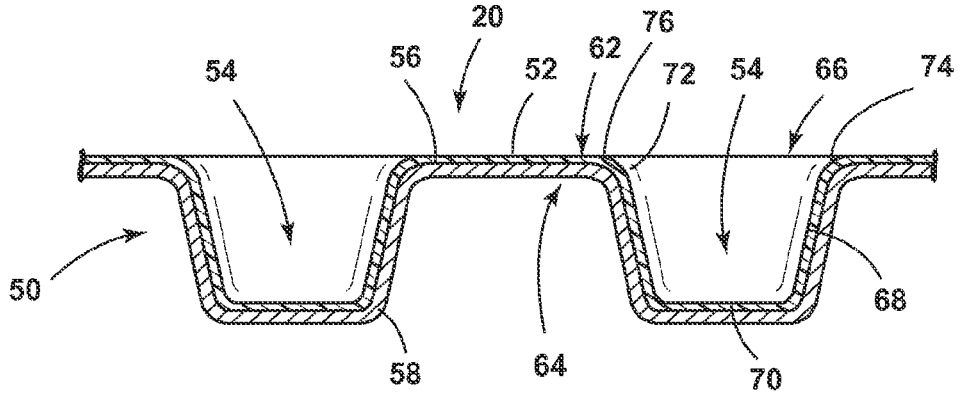
FIG. 4 is a side, cross-sectional view of the ice tray of FIG. 3 taken along line A-A.

Turning now to FIG. 4, the body portion 52 of the ice-forming tray 50 generally comprises a thin sheet of clad metal formed from a first alloy sheet 56 and a second alloy sheet 58, different from the first alloy sheet 56. It is also contemplated that a shape memory metal alloy or a shape memory polymer could be used. Preferably, the first alloy sheet 56 and the second alloy sheet 58 are of similar thickness. In one embodiment, the first alloy sheet 56 is a material with a high CTE, such as an alloy containing 3% chromium, 22% nickel, and 75% iron, and the second alloy sheet 58 is a material having a low coefficient of thermal expansion (CTE), such as Invar, a 36% nickel/iron alloy. Preferably, the first alloy sheet has a CTE between 6.0×10(−6) in/in/° F. and 12.0×10(−6) in/in/° F., and the second alloy sheet has a CTE between 2.0×10(−6) in/in/° F. and 7.0×10(−6) in/in/° F. In one embodiment, the first alloy sheet is wrought aluminum with a CTE of about 12.0×10(−6) in/in/° F.

The body portion 52 generally comprises a thin sheet of clad material having an upper side 62 and a lower side 64. The upper side 62 corresponds to the first alloy sheet 56, and the lower side 64 corresponds to the second alloy sheet 58. The recesses 54 are generally formed by upwardly extending sidewalls 68 and a lower wall 70. The sidewalls 68 and lower walls 70 may be curved and may blend together, such that the terms "sidewall" and "lower wall" do not necessarily refer to vertical and horizontal walls. The sidewalls 68 and lower walls 70 form a concave inner surface 72 defining the recesses 54. The sidewalls 68 may intersect the body portion 52 at an angle of about 90° to define edges 74 extending around the recesses 54 to define the openings 66. The edges 74 may have a radius such that the transition from the body portion 52 to the sidewalls 68 does not form a sharp corner. For example, the inner surface 72 of the sidewall 68 may transition to an upper surface 76 of the body portion to define an outer radius of about 0.050-0.100 inches.

The sidewalls 68 and lower walls 70 may be coated with an organic coating such as a an ice-phobic polymer coating to improve the ability of the tray 50 to release ice. Additionally, the surfaces of the ice-forming recesses 54 may be configured with ice-phobic surfaces (not shown). Ice-phobic surfaces may be a coating on the ice forming tray 50 or may be formed as part of the surface of the ice-forming tray 50. The ice-phobic surfaces are configured on at least all surfaces of recesses 54 exposed to water during the ice-formingty operations of the ice maker 20. Consequently, the ice-phobic surfaces are in contact with ice pieces (not shown) within the recesses 54 of tray 50.

The ice-phobic surfaces may be fabricated from the surface of the tray 50 as a textured surface. Essentially, the surfaces of tray 50 are roughened at a microscopic level to reduce the surface area between pieces of ice and the tray recess 54. This reduced surface area correlates to less adhesion between tray recess 54 and the ice piece.

The ice-phobic surfaces may also include ice-phobic structures (not shown). Ice-phobic structures include various coatings, surface treatments and layers of material that demonstrate significant water repellency. The ice-phobic structure may be a coating that conforms to the surface of ice-forming recess 54. During formation and harvesting of ice pieces, the ice-phobic structure remains in contact with the ice pieces.

Figure 5:
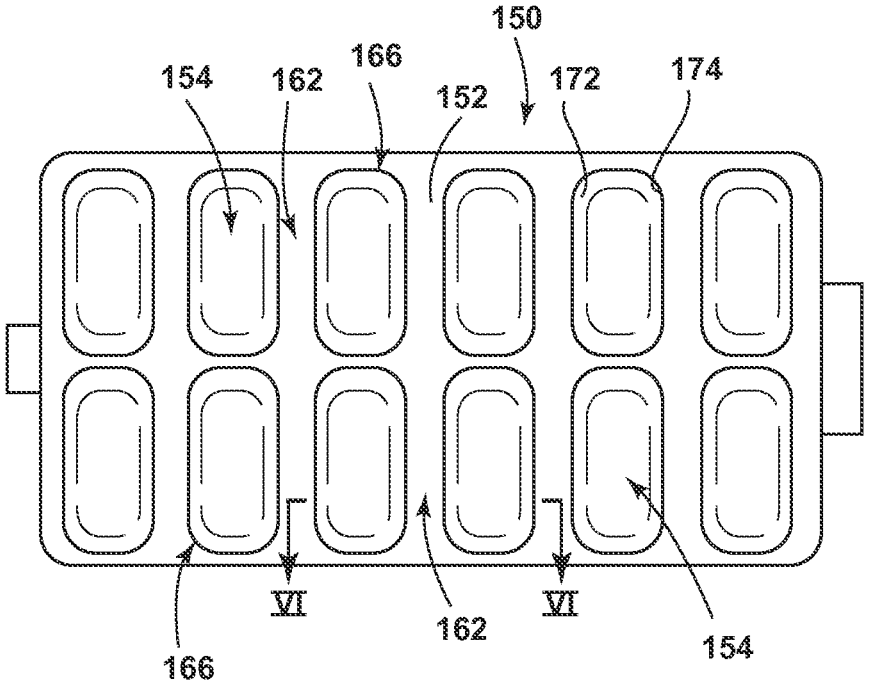
FIG. 5 is a plan view of an ice tray according to a second embodiment of the present invention.
Figure 6:
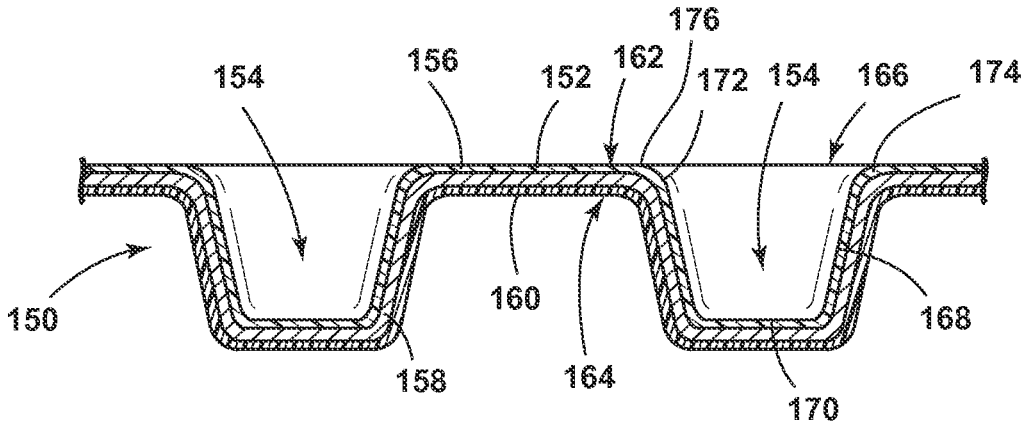
FIG. 6 is a side, cross-sectional view of the ice tray of FIG. 5 taken along line B-B.

In a second embodiment as shown in FIGS. 5 and 6, the body portion 152 of tray 150 generally comprises a thin sheet of clad metal formed from a first alloy sheet 156, a second alloy sheet 158 different from the first alloy sheet 156, and a third alloy sheet 160 different from the first alloy sheet 156 and the second alloy sheet 158. Preferably, the first alloy sheet 156, the second alloy sheet 158, and the third alloy sheet 160 are of similar thickness. In one embodiment, the first alloy sheet 156 is a material with a high CTE, such as an alloy containing 3% chromium, 22% nickel, and 75% iron, and the second alloy sheet 158 is a material having a low coefficient of thermal expansion (CTE), such as Invar, a 36% nickel/iron alloy. Preferably, the first alloy sheet has a CTE between 6.0×10(−6) in/in/° F. and 12.0×10(−6) in/in/° F., and the second alloy sheet has a CTE between 2.0×10(−6) in/in/° F. and 7.0×10(−6) in/in/° F. The third alloy sheet may have a high electrical resistivity or may contain a metal oxide so as to act as a thin film heater when energized. In one embodiment, the first alloy sheet 156 is wrought aluminum with a CTE of about 12.0×10(−6) in/in/° F., the second alloy sheet 158 has a low CTE, and the third alloy sheet 160 contains a metal oxide.

The body portion 152 generally comprises a thin sheet of clad material having an upper side 162 and a lower side 164. The upper side 162 corresponds to the first alloy sheet 156, and the lower side 164 corresponds to the third alloy sheet 160. The recesses 154 are generally formed by upwardly extending sidewalls 168 and a lower wall 170. The sidewalls 68 and lower walls 170 may be curved and may blend together, such that the terms "sidewall" and "lower wall" do not necessarily refer to vertical and horizontal walls. The sidewalls 168 and lower walls 170 form a concave inner surface 172 defining the recesses 154. The sidewalls 168 may intersect the body portion 152 at an angle of about 90° to define edges 174 extending around the recesses 154 to define the openings 166. The edges 174 may have a radius such that the transition from the body portion 152 to the sidewalls 168 does not form a sharp corner. For example, the inner surface 172 of the sidewall 168 may transition to an upper surface 176 of the body portion to define an outer radius of about 0.050-0.100 inches.

The sidewalls 168 and lower walls 170 may be coated with an organic coating such as an ice-phobic coating to improve the ability of the tray 150 to release ice.

Additionally, the surfaces of the ice-forming recesses 154 may be configured with ice-phobic surfaces (not shown). Ice-phobic surfaces may be a coating on the ice forming tray 150 or may be formed as part of the surface of the ice-forming tray 150. The ice-phobic surfaces are configured on at least all surfaces of recesses 154 exposed to water during the ice-formation operations of the ice maker 20. Consequently, the ice-phobic surfaces are in contact with ice pieces (not shown) within the recesses 154 of tray 150.

The ice-phobic surfaces may be fabricated from the surface of the tray 150 as a textured surface. Essentially, the surfaces of tray 150 are roughened at a microscopic level to reduce the surface area between pieces of ice and the tray recess 154. This reduced surface area correlates to less adhesion between tray recess 154 and the ice piece.

The ice-phobic surfaces may also include ice-phobic structures (not shown). Ice-phobic structures include various coatings, surface treatments and layers of material that demonstrate significant water repellency. The ice-phobic structure may be a coating that conforms to the surface of ice-forming recess 154. During formation and harvesting of ice pieces, the ice-phobic structure remains in contact with the ice pieces.

A process for making ice in an icemaker having a bi-clad metal ice tray according to a preferred embodiment of the present invention is as follows.

Referring again to FIGS. 1, 2, 4, and 6, the refrigerator 10 includes a freezer compartment 16, a controller (not shown), and a cooling system (not shown) that is operably connected to the controller. A water distribution system is operable to permit a predefined volume of water to be introduced into each recess 54, 154. The water distribution system may comprise any of the various, known configurations for performing this function and will therefore not be described in detail herein. The frame body 40 is secured to the freezer compartment, and the ice forming tray 50 is located within the frame body 40. After a predetermined amount of water is introduced into each recess 54, 154, the water freezes to form ice pieces.

The ice tray 50, 150 may be heated or cooled, such that the changes in temperature causes either the first alloy sheet 56, 156 or the second alloy sheet 58, 158 to expand. Preferably, the first alloy 156 sheet expands. This expansion creates shear stresses between the ice pieces and the ice tray 50, 150, releasing the ice pieces from the ice tray 50, 150.

The ice tray 50, 150 is rotated about an axis defined by the tray connector pin (not shown) by known means such that the ice pieces fall into the ice piece collection receptacle 22 positioned below. Various known harvesting devices are available and will therefore not be described in detail. It will be understood that ice tray 50, 150 may be manually rotated by a user to thereby remove ice pieces.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A clad metal ice forming tray assembly for a refrigerator, comprising: a clad metal comprised of at least a first alloy sheet and a second alloy sheet different from the first and having different coefficients of thermal expansion; and an ice recess stamped in the clad metal, defined along its bottom by a bottom surface and its sides by at least one wall extending upwardly from and completely around the bottom surface, wherein the bottom surface and the at least one wall comprise the clad metal; wherein each of the bottom surface and the at least one wall comprises a continuous interior surface which faces the ice recess and a continuous exterior surface which faces away from the ice recess, said ice forming tray assembly further comprising a layer of an organic coating disposed on the interior surface of the ice recess; wherein the continuous interior surface comprises only the first alloy sheet and the exterior continuous surface comprises only the second alloy sheet; said first alloy sheet having a coefficient of thermal expansion between about 6.0×10(−6) in/IN° F. and 12.0×10(−6) in/IN° F. and said second alloy sheet having a coefficient of thermal expansion between about 2.0×10(−6) in/IN° F. and 7.0×10(−6) in/IN° F.

2. The clad metal ice forming tray assembly of claim 1, having a plurality of ice recesses.

3. The clad metal ice forming tray assembly of claim 1, wherein the first alloy sheet and the second alloy sheet are of similar thickness.

4. The clad metal ice forming tray assembly of claim 1, wherein the second alloy sheet is an alloy comprising about 36% nickel and 64% iron.

5. The clad metal ice forming tray assembly of claim 1, wherein the first alloy sheet is an alloy comprising about 3% chromium, 22% nickel, and 75% iron.

6. The clad metal ice forming tray assembly of claim 1, further comprising a third alloy sheet different from the first and second alloy sheets.

7. The clad metal ice forming tray assembly of claim 1, wherein the organic coating is a polyester powder coating.

8. The clad metal ice forming tray assembly of claim 1 wherein a thickness of the ice forming tray is approximately 0.5 millimeters.

9. A method of making and releasing ice from a clad metal ice forming tray assembly for a refrigerator, comprising: providing a clad metal ice forming tray comprising a clad metal having at least a first continuous alloy sheet and a second continuous alloy sheet different from the first and having different coefficients of thermal expansion and at least one ice recess stamped in the clad metal, defined along its bottom by a bottom surface and its sides by at least one wall extending upwardly from and completely around the bottom surface, wherein the bottom surface and the at least one wall comprise the clad metal, wherein each of the bottom surface and the at least one wall comprises an interior surface which faces the ice recess and an exterior surface which faces away from the ice recess, whereby an organic coating is disposed on the interior surface; introducing a volume of water into each at least one recess to freeze the water; freezing creating shear stress between the ice forming tray and the ice by modifying the temperature of the ice forming tray such that one of the first or second alloy sheets expands due to its coefficient of thermal expansion;

wherein the ice forming tray releases the ice; wherein the interior surface comprises the first alloy sheet and the exterior surface comprises the second alloy sheet; said first alloy sheet having a coefficient of thermal expansion between about 6.0×10(−6) in/IN° F. and 12.0×10(−6) in/IN° F. and said second alloy sheet having a coefficient of thermal expansion between about 2.0×10(−6) in/IN° F. and 7.0×10 (−6) in/IN° F.

10. The method of claim 9, wherein the ice forming tray has a plurality of ice recesses.

11. The method of claim 9, wherein the first alloy sheet and the second alloy sheet are of similar thickness.

12. A clad metal ice forming tray assembly for a refrigerator, comprising:

a clad metal comprised of a first continuous alloy sheet, a second continuous alloy sheet different from the first alloy sheet, and a third continuous alloy sheet different from the first alloy sheet and the second alloy sheet, said first and second alloy sheets having different coefficients of thermal expansion, said third alloy sheet having high electrical resistivity;

an ice recess stamped in the clad metal, defined along its bottom by a bottom surface and its sides by at least one wall extending upwardly from and completely around the bottom surface, wherein the bottom surface and the at least one wall comprise the clad metal;

wherein each of the bottom surface and the at least one wall comprises an interior surface which faces the ice recess and an exterior surface which is facing away from the ice recess; wherein the interior surface comprises the first alloy sheet and the exterior surface comprises the second alloy sheet; said first alloy sheet having a coefficient of thermal expansion between about 6.0×10(−6) in/IN° F. and 12.0.×10(−6) in/IN° F. and said second alloy sheet having a coefficient of thermal expansion between about 2.0×10(−6) in/IN° F. and 7.0.×10(−6) in/IN° F.

13. The clad metal ice forming tray assembly of claim 12 whereby the third alloy sheet comprises a metal oxide.

* * * * *